United States Patent [19]

Martinmaas

[11] 4,023,566

[45] May 17, 1977

[54] BODY-SUPPORTING MEANS WITH ADJUSTABLE VIBRATORY MEANS IN THE AUDIBLE FREQUENCY RANGE

[76] Inventor: Werner W. Martinmaas, 2340 Skyline Blvd., Reno, Nev. 59501

[22] Filed: Oct. 10, 1975

[21] Appl. No.: 621,358

[52] U.S. Cl. ..... 128/33; 179/1 E

[51] Int. Cl.[2] ..... A61H 1/00

[58] Field of Search ..... 179/1 E, 1 GA, 146 H; 128/33

[56] References Cited

UNITED STATES PATENTS

| | | | |
|---|---|---|---|
| 3,113,633 | 12/1964 | Eberhardt et al. | 181/145 |
| 3,556,088 | 1/1971 | Leonardini | 128/33 |
| 3,880,152 | 4/1975 | Nohmura | 128/33 |

*Primary Examiner*—William C. Cooper

*Attorney, Agent, or Firm*—Wegner, Stellman, McCord, Wiles & Wood

[57] ABSTRACT

A chair or bed consists of a base structure forming a closed, external housing and a body-supporting means which cooperates with the housing to provide a chamber which is closed but for pressure relief openings. One or more loudspeakers is mounted in the chamber facing the body-supporting means, and each speaker is operatively connected to an amplifier so that it may produce vibrations within the chamber which are in the audible frequency range, and which are transmitted through the body-supporting means to an occupant thereof. The amplifier is of standard type which functions either with a radio receiver or with a phonograph, and which has a volume control for varying the intensity of the vibrations and tone controls for varying the output as between bass and treble.

12 Claims, 4 Drawing Figures

BODY-SUPPORTING MEANS WITH ADJUSTABLE VIBRATORY MEANS IN THE AUDIBLE FREQUENCY RANGE

BACKGROUND OF THE INVENTION

Many people enjoy receiving the vibrations of music through the body, in addition to the enjoyment of the sound which is sensed through the ears. This fact is clearly evidenced by the enormously high decibel ratings at which many people, and particularly young people, like to listen to music. With conventional equipment, this is the only way in which a person, either listening to a "live" performance, or to radio music or recorded music, can get a substantial physical effect from the music other than through the ears.

It is a well-known fact that highly amplified music, like any other very loud sounds, can cause severe auditory damage; but in spite of this fact many people prefer listening to music at sound levels which are damaging to the ear. The principal reason for doing so is to receive the direct vibration of the music through other parts of the body than the ears.

SUMMARY OF THE INVENTION

I have discovered that by providing a body-supporting means, such as a chair or a bed, which has a closed chamber with loudspeakers in the chamber and directed toward the body-supporting means, the desired direct vibration of the body by the music can be produced with so little of the sound escaping from the chamber that an occupant of the chair needs to listen to the music through earphones or outside loudspeakers. The chamber may be completely enclosed except for a few small openings to permit equalization of pressure inside and outside the chamber.

Preferably, a base member provides an enclosed external housing, and the body-supporting means is peripherally sealed to the housing and cooperates therewith to provide the chamber. One or more loudspeakers are mounted on the housing wall facing the body-supporting means, and an external shell houses the rear of the speakers and is sealed to the housing. Preferably, the outer shell has an opening or openings in the vicinity of the speakers which are provided with closures that permit adjustment of the sound level in the vicinity of the apparatus.

Excellent results are obtained by connecting the loudspeakers to a conventional amplifier which is hooked up either to a radio receiver or to a source of recorded music. The conventional amplifier, of course, is provided with a volume control and also with tone controls by which the occupant of the chair may change the balance between the frequency of the vibrations produced by the speakers.

A chair which has two speakers directed toward the backrest produces excellent results, as does a bed which has two or more speakers beneath it and facing upwardly.

Best results are obtained by fabricating the structure from plastics, so that the housing and the body-supporting means may be essentially unitary, and by providing a relatively thin pad of a material such as plastic foam which does not afford excessive damping of the vibration of the body-supporting means.

Many people who have tested a prototype of the apparatus here disclosed have stated that they can make the device either stimulating or relaxing by varying the type of music, the volume of the vibrations, and the balance between bass and treble frequencies.

The apparatus is capable of providing rather high intensity vibration of the body while holding the sound level so low that it is not troublesome to other persons in a room where the device is in use, and far below the level at which there can be any auditory damage.

THE DRAWINGS

DETAILED DESCRIPTION OF THE INVENTION

Figure 1:
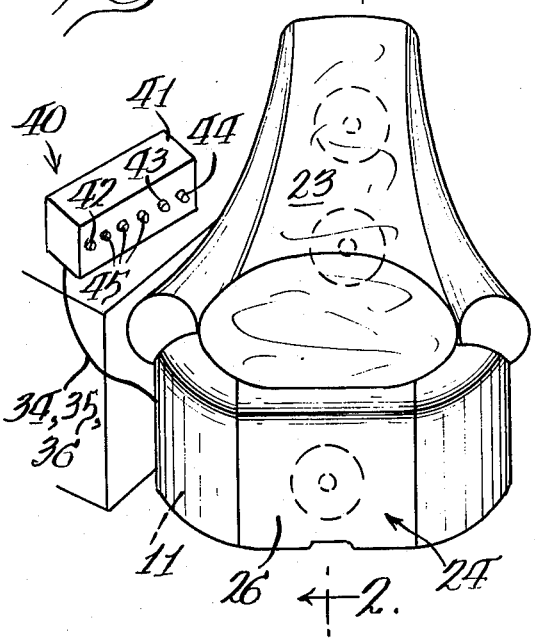
FIG. 1 is a perspective view of the apparatus of the invention as embodied in a chair provided with a leg rest.
Figure 2:
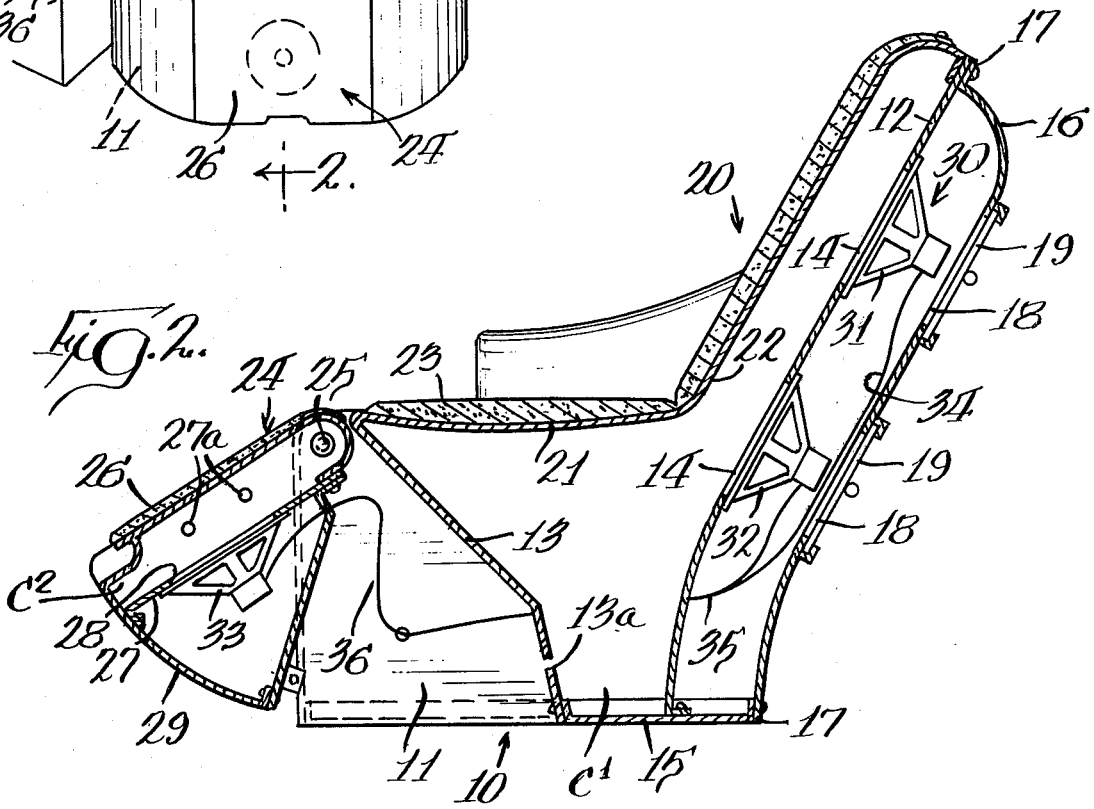
FIG. 2 is a longitudinal, central sectional view of the apparatus, on an enlarged scale, taken substantially as indicated along the line 2—2 of FIG. 1.

Referring to the drawings in detail, and referring first to FIGS. 1 and 2, as embodied in a chair the apparatus of the invention includes a base, indicated generally at 10; body-supporting means, indicated generally at 20; and a sound system, indicated generally at 30, which is operatively connected to an amplifier, indicated generally at 40.

The base 10 includes a continuous side and front wall 11 and a back wall 12 which is effectively integral with the wall 11 so as to provide an external housing consisting of the walls 11 and 12. The external housing also includes a transverse front wall 13 which, in the illustrated embodiment, is positioned to provide a recess for a leg rest. Thus the walls 11, 12 and 13 are connected, and the housing is upwardly open.

The rear wall 12 is provided with a pair of speaker openings 14; and the housing also includes a bottom wall 15 and a speaker enclosure panel 16 the periphery 17 of which is sealed to other parts of the housing. Openings 18 are formed in the speaker enclosure panel 16 in alignment with the openings 14; and double sliding doors 19 permit the openings 18 to be completely closed or to be opened to any desired extent.

In the illustrated embodiment, the body-supporting means 20 includes a seat 21, a back rest 22, a relatively thin pad 23 on the seat and back rest, and a leg rest, indicated generally at 24. The seat 21 and back rest 22 are peripherally sealed to the housing 11-12-13, and cooperate therewith to provide a chamber C1 which is entirely enclosed except for pressure equalizing ports **13*a* which are formed in the wall 13 where they are concealed from view. As illustrated, the leg rest 24 is pivoted directly upon the base 10 at 25, and consists of a leg-supporting wall 26 and a rear wall 27 which cooperate to form a chamber $C^2$ which is closed except for a speaker opening 28 and a few small pressure equalizing ports 27*a* to equalize pressure inside and outside the chamber $C^2$. Peripherally connected to the wall 27 is a speaker enclosure 29**.

The leg rest is illustrated as being directly pivotally mounted upon the base purely as a matter of convenience. It is obvious to one skilled in the art that the leg rest could also be mounted upon a lazy tongs type of linkage so as to be projected forwardly away from the seat 21 as it is moved to an elevated position. Conventional means are, of course, provided for manually moving the leg rest 24 between a retracted position in which the leg supporting wall 26 is generally flush with the front of the base wall portion 11, and an elevated leg supporting position which may be as illustrated in FIG. 2 or at a higher elevation substantially copolanar with the seat 21; and the device is also provided with conventional means for locking the leg rest in any of several desired adjusted positions. Such mechanical arrangements are very well known and form no part of the present invention.

The speaker system 30 includes an upper loudspeaker 31 which is mounted upon the base back panel 12 in alignment with the opening 14 and facing toward the back rest 22; a lower loudspeaker 32 which faces the backrest 22 and the rear of the seat 21 through the opening 15; and a leg rest speaker 33 which is mounted upon the rear leg rest wall 27 and faces the leg supporting wall 26 through the opening 28. The speakers 31, 32 and 33 are operatively connected by wires 34, 35 and 36 to the amplifier 40. Preferably the loudspeakers provide the full range of frequencies in the audible range, as do the speakers in any good high fidelity sound system.

The amplifier 40 is of a conventional type which is mounted in a housing 41 and has a volume control provided with a manual control knob 42 which serves as means for varying the intensity of vibrations produced by the speaker system 30; and the amplifier also includes bass and treble adjustment controls provided with adjusting knobs 43 and 44 which serve as means for varying the output of the speakers as between vibration in different frequency ranges.

The amplifier 40 may include radio receiving means, in which case it is equipped with a tuner and tuning knobs 45 for AM or FM reception; or alternatively the amplifier may be connected to a record player or tape deck (not shown) in the usual way. Commonly, of course, such an amplifier includes a tuner and is also connected to a record player or a tape deck or both.

Figure 4:
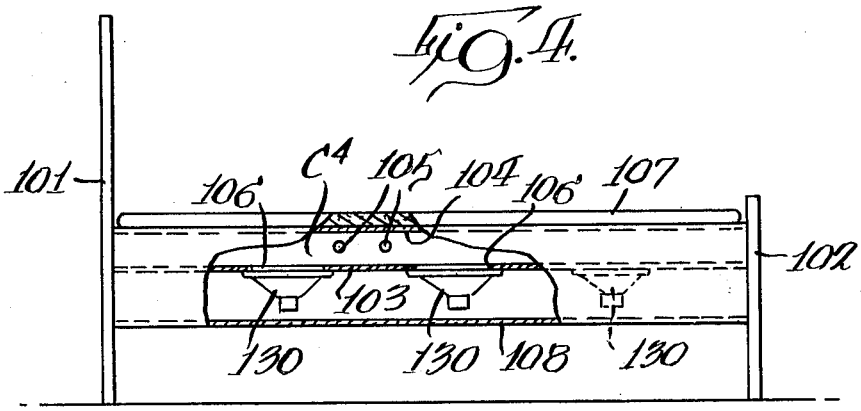
FIG. 4 is a side elevational view, partly in section, of a bed embodying the apparatus of the invention.

Referring now to FIG. 4, a bed embodying the invention includes a headboard 101, a foot board 102, a lower housing wall 103, and a body-supporting wall 104 which cooperates with the head and foot boards and the bottom wall to define a chamber C4 which is fully enclosed except for a few distributed pressure equalizing openings 105 and speaker openings 106. A relatively thin foamed plastic or foam rubber mattress 107 rests directly upon the body-supporting wall 104.

In spaced relation to the wall 103 is a speaker enclosure wall 108; and a plurality of loudspeakers 130 are mounted upon the wall 103 facing the body-supporting wall 104 through the speaker openings 106.

As in the first embodiment of the invention, the speakers 130 are operatively connected to an amplifier (not illustrated) which is identical with the amplifier 40 seen in FIG. 1.

Figure 3:
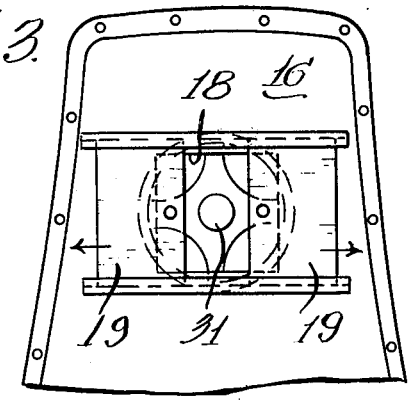
FIG. 3 is a fragmentary rear elevational view of the apparatus of FIG. 1.

A prototype of the chair illustrated in FIGS. 1 to 3, but without the leg rest 24 was fabricated from ¼ inch thick high density vinyl plastic, which provides a structure of ample strength and which transmits vibrations in the auditory range through the body-supporting means 20 and into the body of a person occupying the chair. The prototype has a pad 23 of foam rubber, which is approximately 1½ inches thick.

The foregoing detailed description is given for clearness of understanding only and no unnecessary limitations should be understood therefrom, as modifications will be obvious to those skilled in the art.

I claim:

1. A device for supporting the body of a person comprising, in combination:

a base structure comprising a plurality of connected walls which define a housing that is upwardly open;

effectively uninterrupted rigid body-supporting means comprising a sheet of material which forms the top of said housing and has its periphery secured to said plurality of connected walls to define a chamber which, at least when the device is on a supporting surface, is enclosed but for pressure relief openings of minimal area and a loud speaker opening in one of said plurality of connected walls;

a loudspeaker mounted in immediate confronting proximity to said loudspeaker opening and facing the body-supporting means, there being means for operatively connecting said loudspeaker to means including an electronic amplifier so that it may produce vibrations of the air within the chamber which are in the audible frequency range, whereby an occupant of the device receives said vibrations through the rigid body-supporting means, said amplifier being provided with means for varying the intensity of said vibrations;

and means enclosing the rear of said loudspeaker.

2. The combination of claim 1 in which the loudspeaker is mounted on said one of said connected walls.

3. The combination of claim 1 in which the means enclosing the rear of the loudspeaker is an enclosure panel substantially coextensive with said one of said connected walls and having its entire margin secured thereto.

4. The combination of claim 1 in which the means enclosing the rear of the loudspeaker is an enclosure panel which has its entire margin secured to said one of said connected walls, there is an opening in said enclosure panel in the vicinity of the loudspeaker, and a closure for said opening which may be adjusted to modulate the level of sound outside the device.

5. The combination of claim 1 in which the body-supporting means comprises a chair having a seat and a back rest.

6. The combination of claim 5 in which the loudspeaker faces the back rest.

7. The combination of claim 6 in which the loudspeaker is mounted on said one of said connected walls.

8. The combination of claim 6 in which the means enclosing the rear of the loudspeaker is an enclosure panel which has its entire margin secured to said one of said connected walls, there is an opening in said enclosure panel in the vicinity of the loudspeaker, and a closure for said opening which may be adjusted to modulate the level of sound outside the device.

9. The combination of claim 5 which includes a bottom wall peripherally secured to the lower margins of said plurality of connected walls.

10. The combination of claim 5 in which the body-supporting means includes a leg rest which is mounted at the front of the seat for movement between an idle retracted position and an extended, leg-supporting position, said leg rest has a leg-supporting wall and at least one other wall which has a loudspeaker opening and cooperates with said leg-supporting wall to form a chamber, a loudspeaker is mounted on said chamber confronting the loudspeaker opening and facing the leg-supporting wall, and means is provided enclosing the rear of said loudspeaker.

11. The combination of claim 1 in which the housing is rectangular, the plurality of connected walls have upper margins in a horizontal plane, and the body-supporting means is horizontal to form a bed.

12. The combination of claim 1 in which the base structure and the body-supporting means are plastic mouldings integrally joined to one another.

* * * * *